US007942156B2

(12) United States Patent
Francisco et al.

(10) Patent No.: US 7,942,156 B2
(45) Date of Patent: May 17, 2011

(54) SCREENING ARRANGEMENT FOR A DISHWASHING APPLIANCE, AND ASSOCIATED APPARATUS

(75) Inventors: Virgil J. Francisco, Ayden, NC (US); Wyatt Wertz, Princeton, NC (US); Mark D. Montgomery, Greenville, NC (US); Jason M. Patterson, Trenton, NC (US); James L. Burrows, Winterville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 245 days.

(21) Appl. No.: 12/274,481

(22) Filed: Nov. 20, 2008

(65) Prior Publication Data

US 2010/0122715 A1 May 20, 2010

(51) Int. Cl.
*B08B 3/02* (2006.01)

(52) U.S. Cl. ..... 134/111; 210/232

(58) Field of Classification Search ..... 134/110, 134/111; 210/232, 498, 499
See application file for complete search history.

(56) References Cited

U.S. PATENT DOCUMENTS

| | | | | | |
|---|---|---|---|---|---|
| 703,683 | A | * | 7/1902 | Vrooman et al. | 209/395 |
| 3,322,285 | A | * | 5/1967 | Lopp | 210/314 |
| 3,334,750 | A | | 8/1967 | Ullman, Jr. | |
| 3,335,867 | A | | 8/1967 | Perl | |
| 3,561,605 | A | * | 2/1971 | Likness | 210/497.1 |
| 4,243,431 | A | | 1/1981 | Dingler et al. | |
| 5,255,790 | A | * | 10/1993 | Einoder et al. | 209/393 |
| 5,333,631 | A | * | 8/1994 | Kirkland et al. | 134/104.1 |
| 5,450,868 | A | | 9/1995 | Young, Jr. | |
| 5,623,956 | A | | 4/1997 | Kirkland | |
| 5,851,393 | A | * | 12/1998 | Carr et al. | 210/489 |
| 6,237,720 | B1 | * | 5/2001 | Sutton | 184/106 |
| 6,789,681 | B2 | * | 9/2004 | Czerwoniak et al. | 209/405 |
| RE40,098 | E | | 2/2008 | Jeon et al. | |
| 2007/0000525 | A1 | | 1/2007 | Hartvigsson | |

FOREIGN PATENT DOCUMENTS

| | | | |
|---|---|---|---|
| DE | 1 628 609 | * | 1/1997 |
| GB | 2 033 737 | * | 5/1980 |
| JP | 05023279 A | | 2/1993 |
| JP | 05-184853 | * | 7/1993 |
| JP | 06-007613 | * | 1/1994 |
| KR | 2003097182 | | 12/2003 |

OTHER PUBLICATIONS

European Patent Office 0 051 180 Oct. 1981.*
European Patent Office 1 878 377.*

* cited by examiner

*Primary Examiner* — Frankie L Stinson
(74) *Attorney, Agent, or Firm* — Alston & Bird LLP

(57) ABSTRACT

A screening arrangement for screening washing fluid in a dishwashing appliance is provided. Such a screening arrangement comprises intersecting wall members forming a latticework structure, defining opposing inlet and outlet planes, for receiving the washing fluid therethrough. The wall members have inlet and outlet ends disposed toward the respective inlet and outlet planes. The wall member inlet ends, in cross section, have a non-planar apex portion tapering toward the outlet plane. A circumferential member extends about a periphery of the latticework structure, and at least a portion of the circumferential member is sloped toward the latticework structure so as to direct washing fluid received thereby toward the latticework structure. An associated apparatus is also provided.

18 Claims, 15 Drawing Sheets

SCREENING ARRANGEMENT FOR A DISHWASHING APPLIANCE, AND ASSOCIATED APPARATUS

BACKGROUND OF THE INVENTION

1. Field of the Invention

Embodiments of the present invention relate to dishwashing appliances and, more particularly, to a screening arrangement for a dishwashing appliance, and an apparatus associated therewith.

2. Description of Related Art

The effectiveness of a dishwasher may often be directly related to conditions associated with the water used thereby for cleaning dishware and other items. Generally, a dishwasher implements a gravity-fed sump for receiving water from the house water source, wherein the water is circulated by a circulation pump from the sump through the spray arms or other water-distribution provisions of the dishwasher for removing soils from the dishware therein. After removing the soils and other debris, the water is typically directed through a series of straining/screening/filtering mechanisms prior to being re-circulated through the hydraulic system of the dishwasher.

One such straining/screening mechanism is commonly referred to as a "glass trap," which is often configured to strain, screen, or remove large particles (i.e., broken glass, bones, etc.) from the water before the water is further directed toward the sump to other filtration measures for removing finer soils. In this regard, the glass trap generally permits passage of soils therethrough that are of a size capable of moving through the drain system (e.g., hoses, orifices, pumps, valves, etc.) of the dishwashing appliance, while preventing passage of larger soils/objects that are not capable of moving through the drain system. Some current glass trap designs use shelf-like members (i.e., a perforated member having a significant horizontal surface area) to screen large particles from passing therethrough toward the sump. The horizontal surface area may include, for example, upper surfaces of the frame of the glass trap, upper surfaces of the intersecting members forming the straining/screening grid, or the upper surface of any component disposed below the grid of the glass trap. In some cases, this may desirably result in large objects being retained and prevented from entering the sump and/or drain system. Such large objects may be manually removed from the glass trap at the end of the dishwasher program/cycle.

However, due to the structure of some glass traps, certain types of smaller soils (e.g., coffee grounds, partially ground corn) may be retained by and on the horizontal surface area of the glass trap. Such retained soils, both dissolvable (e.g., corn) and indissolvable (e.g., coffee grounds), may be small enough to pass through the drain system of the dishwasher, but, since retained by and on the horizontal upper surfaces of the glass trap, may sometimes be re-deposited onto the dishware. That is, the moving wash water from the spray arm(s)/tub portion may act upon such retained soils, whether dissolvable or indissolvable, disposed on the horizontal upper surfaces of the glass trap, and cause the resulting contaminants to splash back up onto the dishware. This soil re-deposited on the dishware may thus result in a lower cleaning efficiency of the dishwasher. Such smaller soils may include, for example, partially ground corn kernels and coffee grounds, both of which may be readily retained by and on horizontal upper surfaces (i.e., the above-described "horizontal surface area") of the glass trap, even though such smaller soils may be small enough to pass through the glass trap and the drain system.

Thus, there exists a need for an improved screening/filtering arrangement for a dishwashing appliance that is less prone to retaining smaller soils (i.e., those soils that are capable of passing through the glass trap and the drain system of the dishwasher) removed from the dishware and, instead, is configured to more readily direct such smaller soils therethrough toward the sump, while still being effective in screening and retaining larger objects/soils (i.e., those objects/particles not capable of passing through the drain system of the dishwasher) so as to prevent such larger objects from passing therethrough toward the sump.

BRIEF SUMMARY OF THE INVENTION

The above and other needs are met by embodiments of the present invention which, according to one aspect, provides a screening arrangement for a dishwashing appliance having a tub portion adapted to contain washing fluid circulated about dishware received therein, wherein the dishwashing appliance has a sump assembly disposed about a lower end of the tub portion for receiving the washing fluid therein. Such a screening arrangement comprises a plurality of intersecting wall members forming a latticework structure defining an inlet plane and an opposed outlet plane. Each of the wall members has an inlet end disposed toward the inlet plane and an outlet end disposed toward the outlet plane. The inlet ends of the wall members, in cross section, have a non-planar apex portion tapering toward the outlet plane, wherein washing fluid from the tub portion is received through the inlet plane and is directed toward the outlet plane. A circumferential member is operably engaged with and extends about a periphery of the latticework structure. At least a portion of the circumferential member is sloped toward the latticework structure, from the inlet plane toward the outlet plane, so as to direct washing fluid received thereby through the latticework structure and toward the sump assembly.

Another aspect provides a dishwashing appliance comprising a tub portion adapted to contain washing fluid circulated about dishware received therein, and a sump assembly disposed about a lower end of the tub portion for receiving the washing fluid therein. A screening arrangement is disposed between the lower end of the tub portion and the sump assembly for screening the washing fluid directed therethrough. The screening arrangement comprises a plurality of intersecting wall members forming a latticework structure defining an inlet plane and an opposed outlet plane. Each of the wall members has an inlet end disposed toward the inlet plane and an outlet end disposed toward the outlet plane. The inlet ends of the wall members, in cross section, have a non-planar apex portion tapering toward the outlet plane, wherein washing fluid from the tub portion is received through the inlet plane and is directed toward the outlet plane. A circumferential member is operably engaged with and extends about a periphery of the latticework structure, wherein at least a portion of the circumferential member is sloped toward the latticework structure, from the inlet plane toward the outlet plane, so as to direct washing fluid received thereby through the latticework structure and toward the sump assembly.

Thus, various aspects of the present invention provide advantages, as otherwise detailed herein, that may include, but are not limited to: limiting retention of smaller dissolvable and indissolvable soils, promoting breakdown of dissolvable soils, and increasing the horizontal velocity component of washing fluid directed therethrough toward the sump, while maintaining sufficient retention capabilities for elongate/large soils, so as to improve the cleaning efficiency of a dishwashing appliance.

BRIEF DESCRIPTION OF THE SEVERAL VIEWS OF THE DRAWINGS

Figure 1:
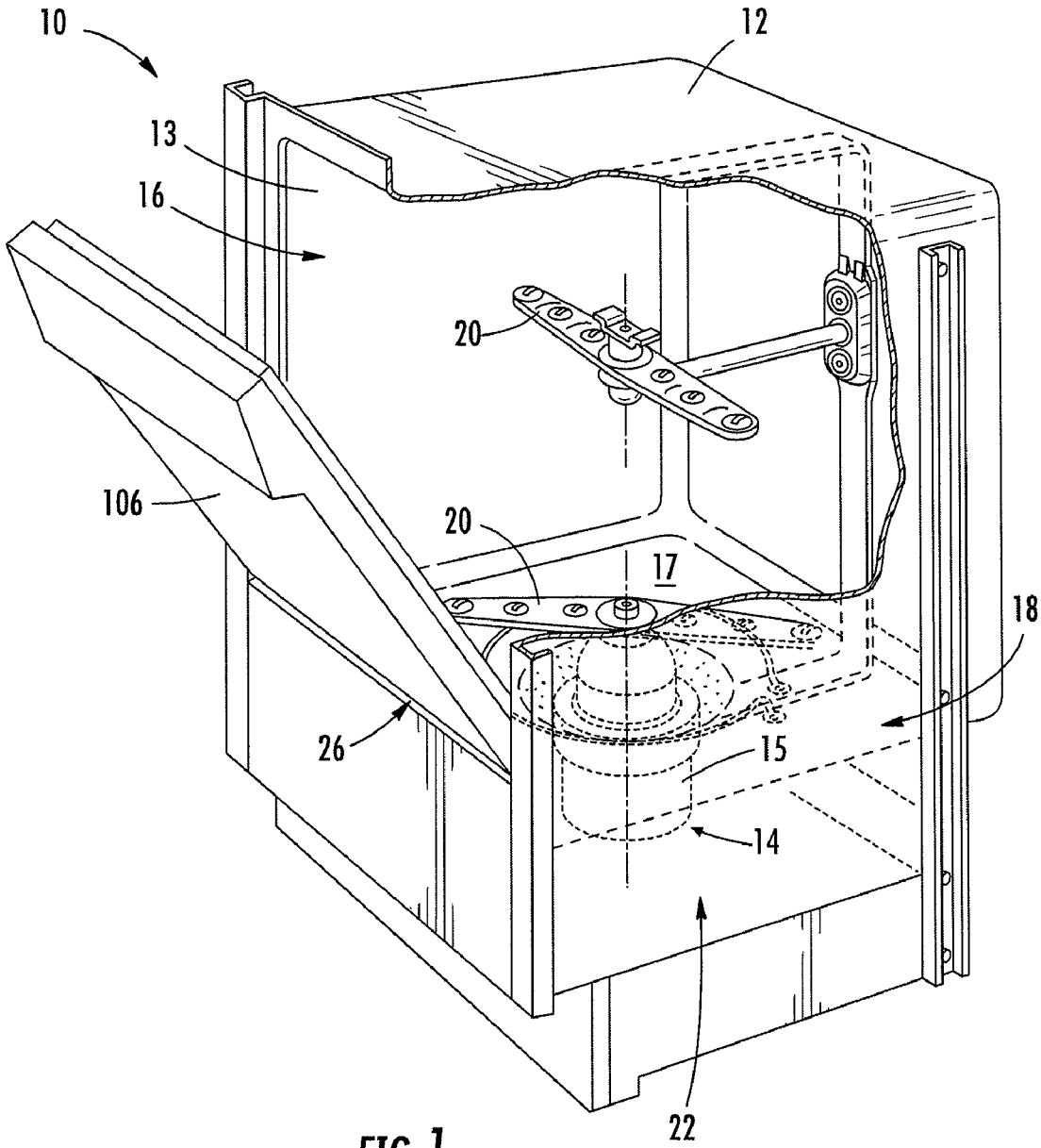
Figure 2:
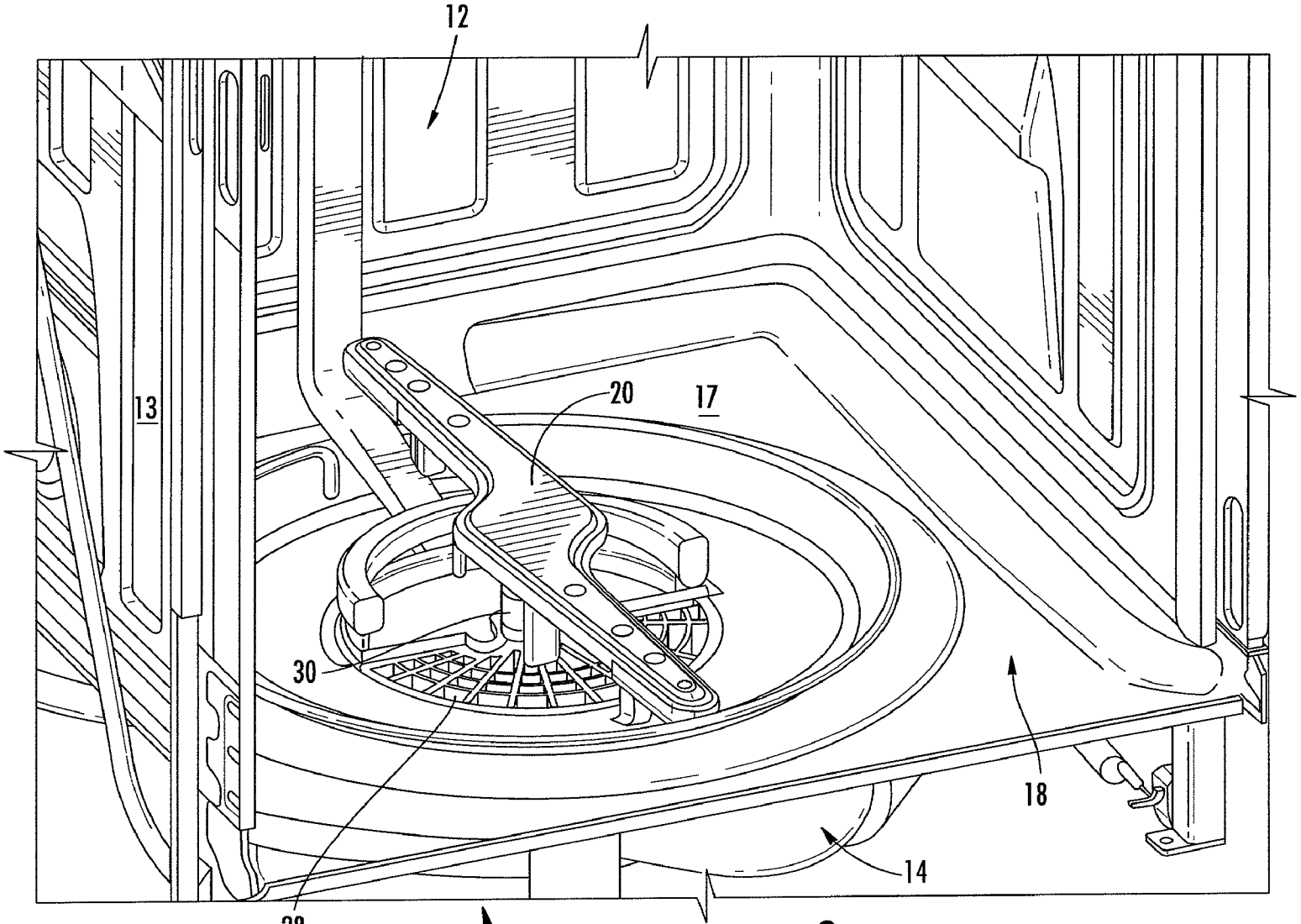
Figure 3:
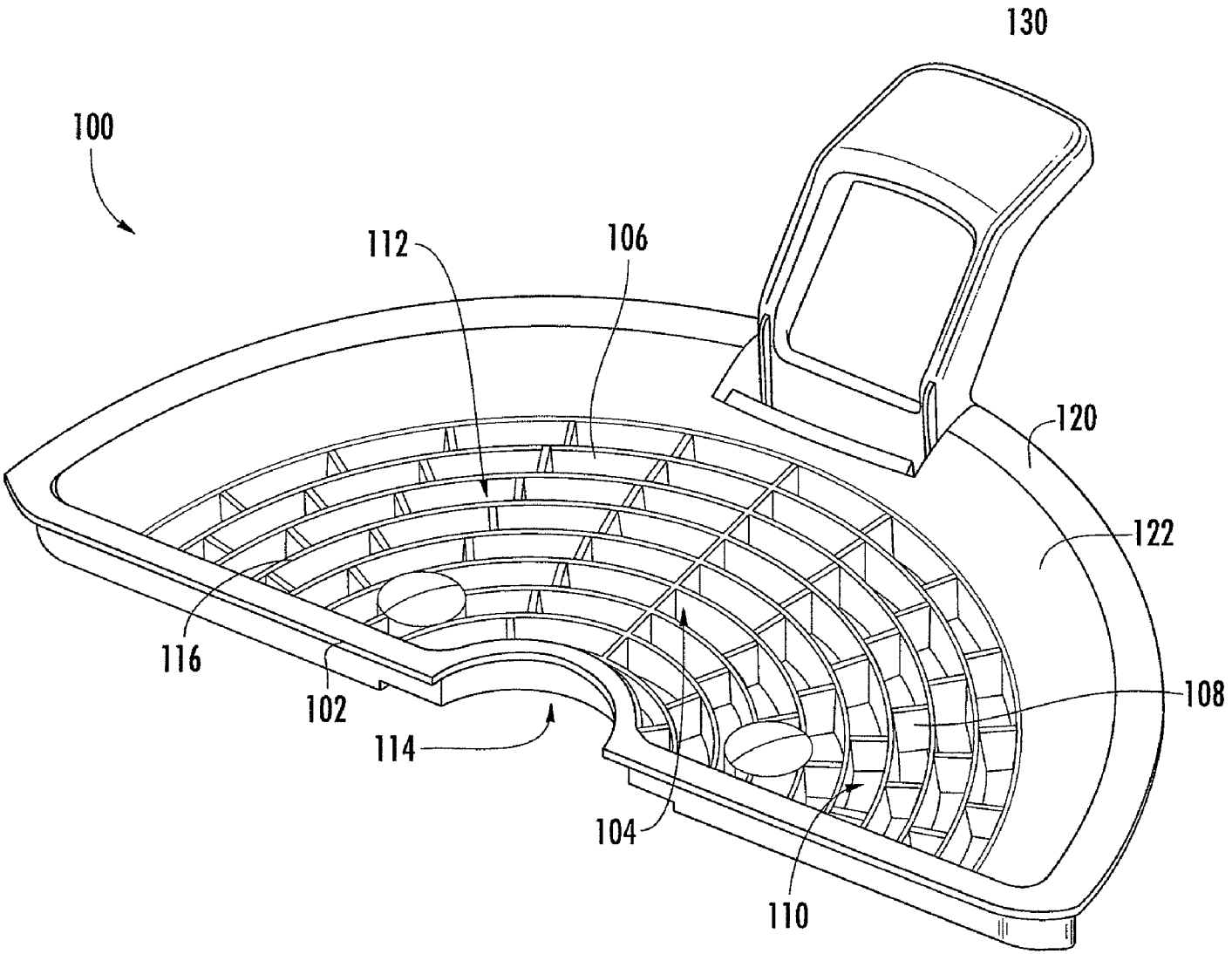
Figure 4:
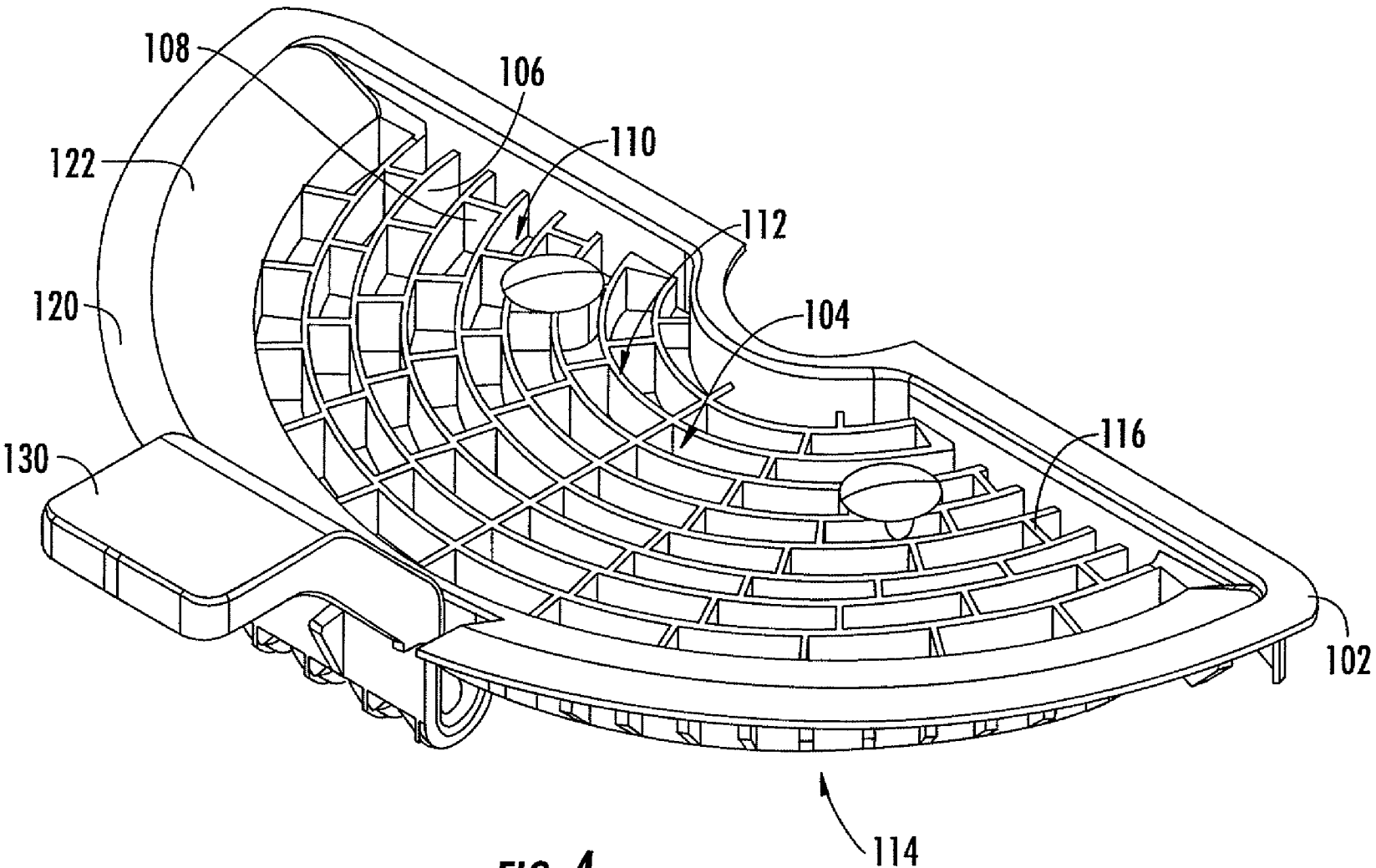
Figure 5B:
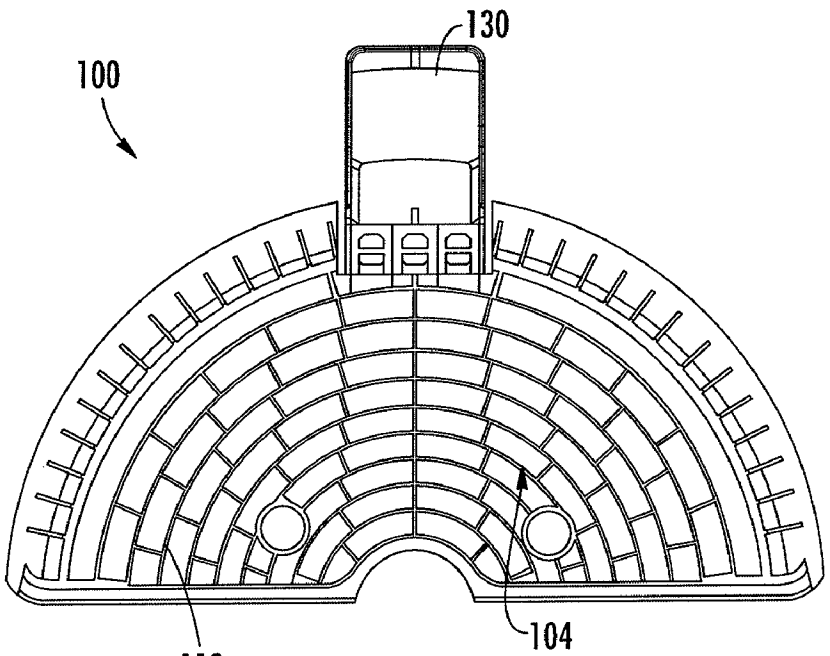
Figure 5A:
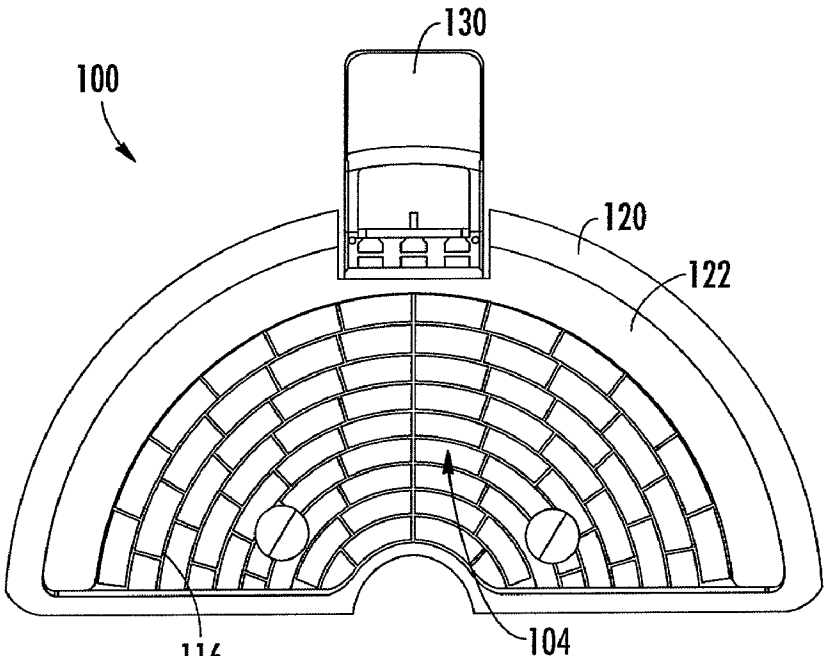
Figure 6B:
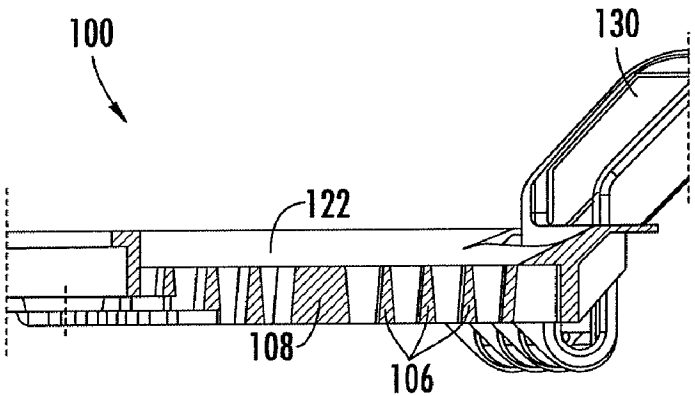
Figure 6A:
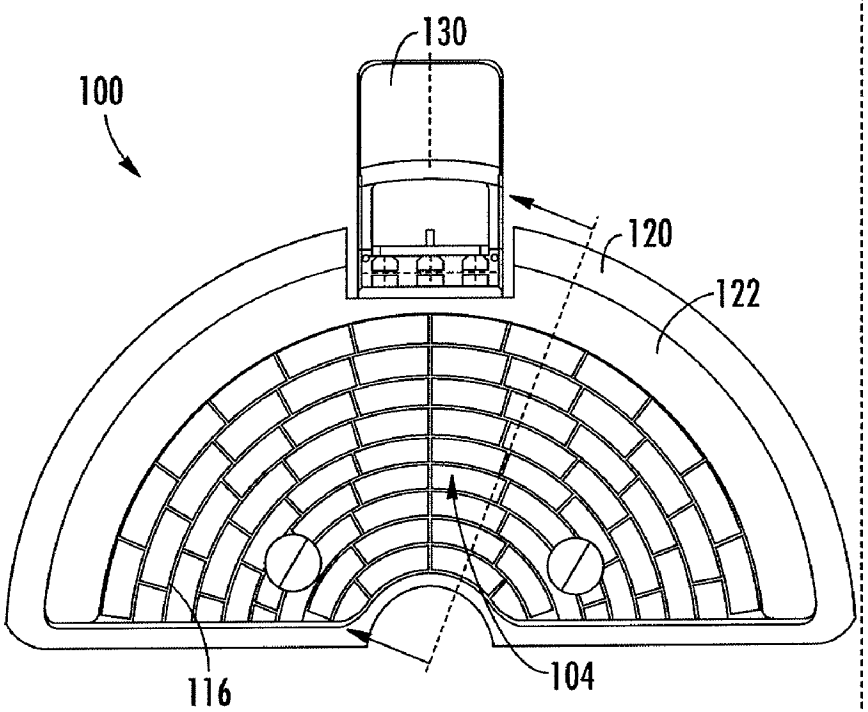
Figure 7A:
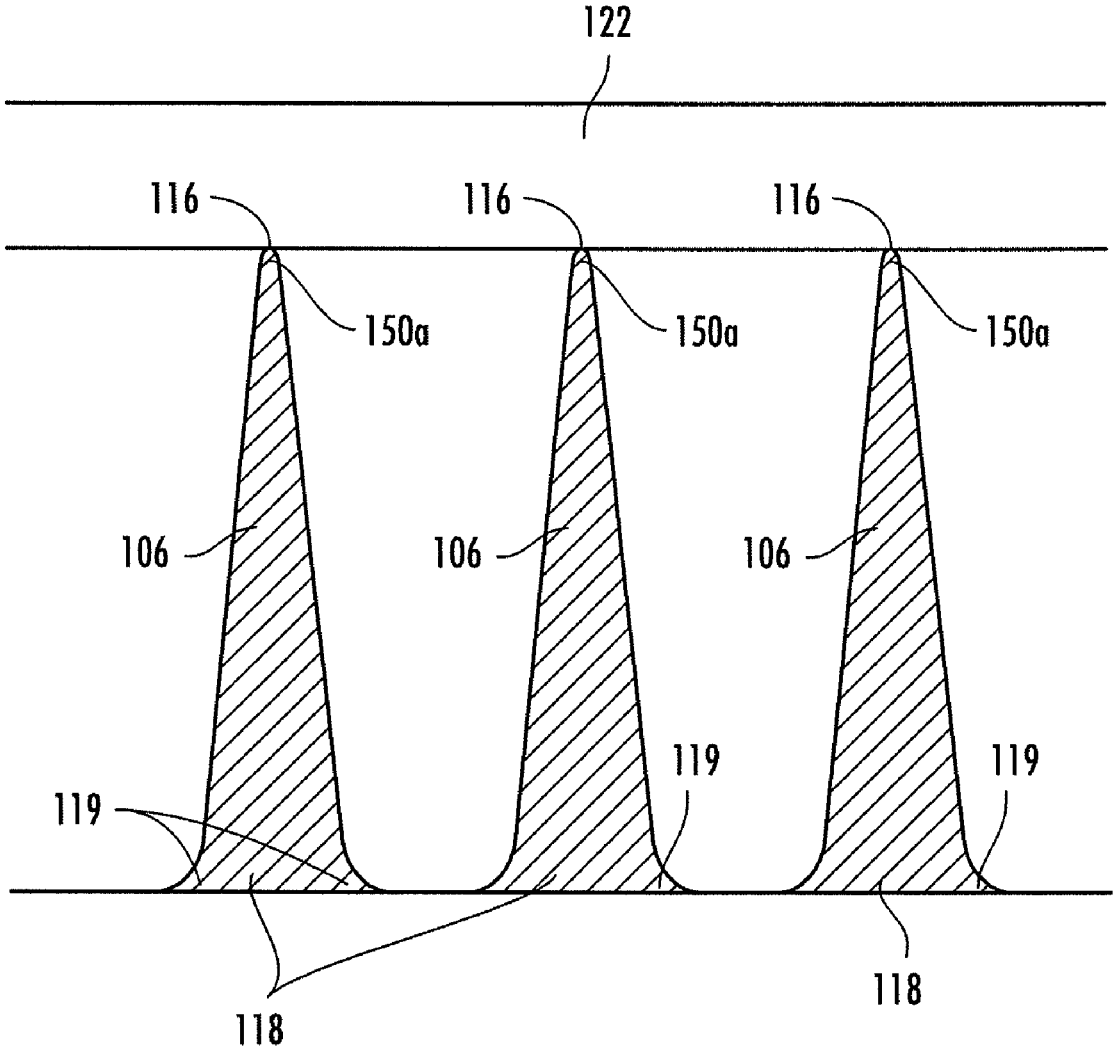
Figure 7B:
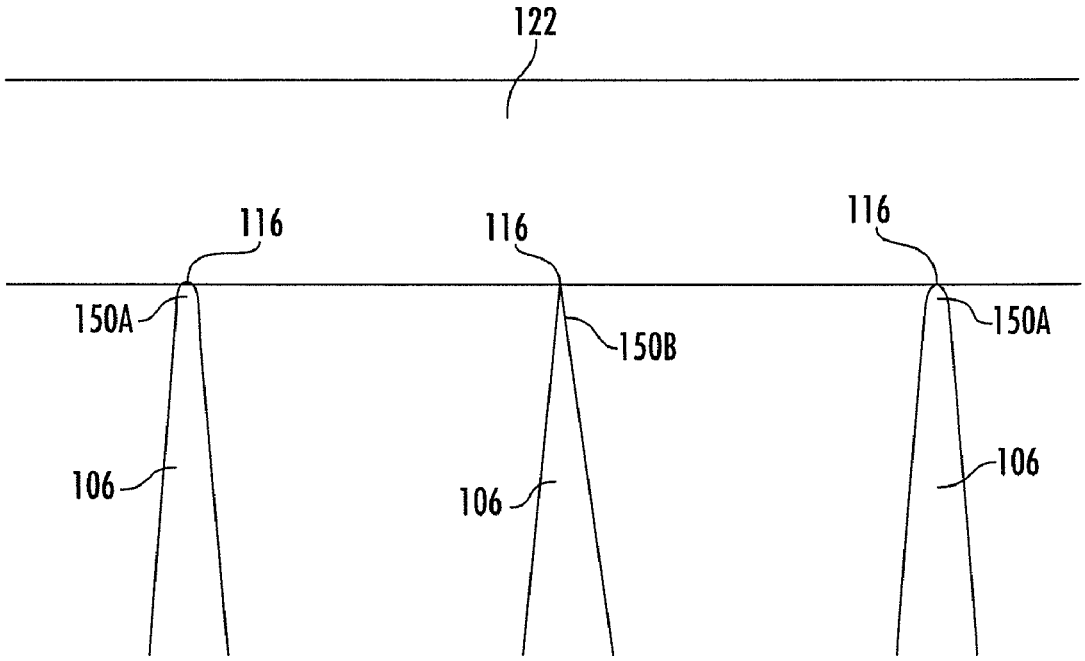
Figure 8:
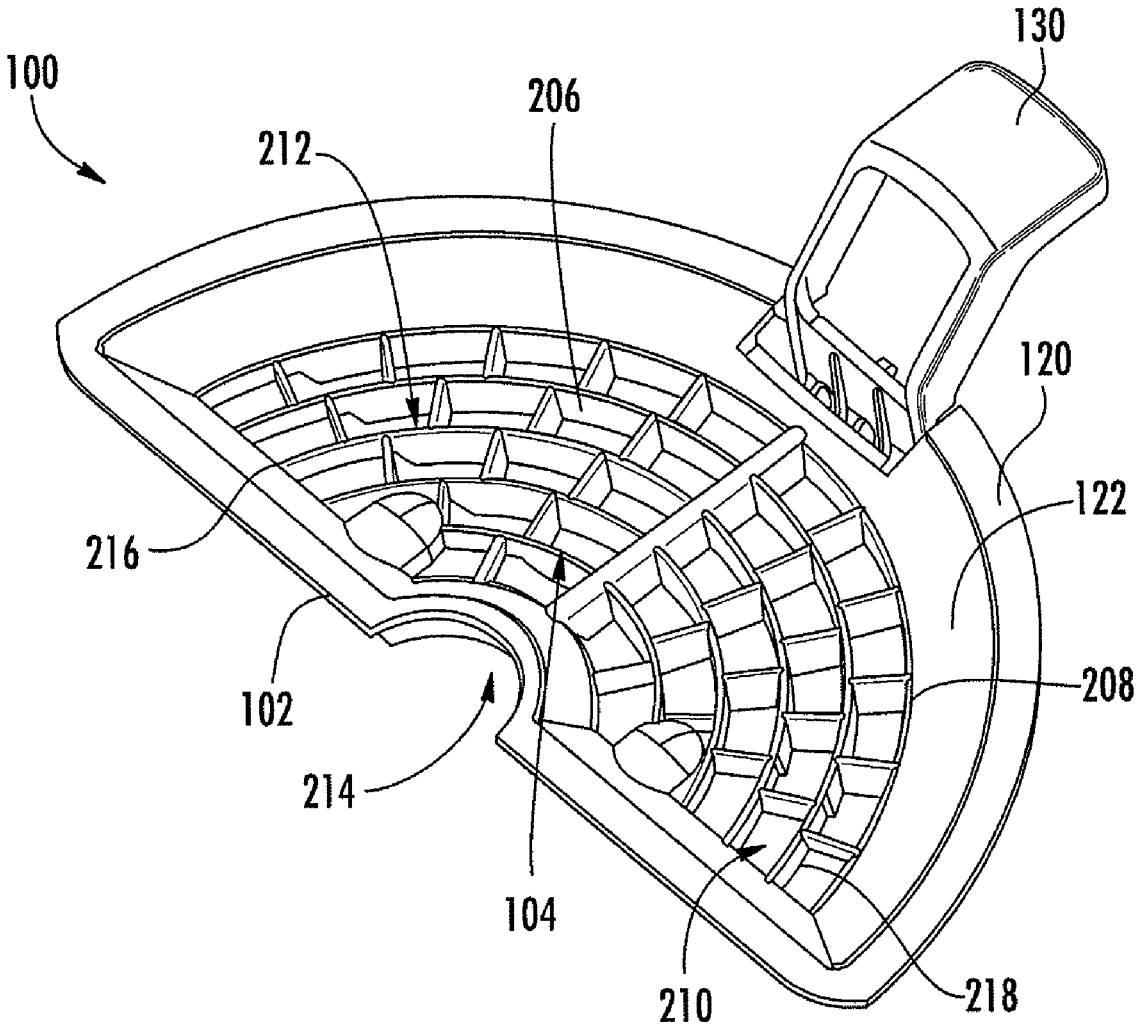
Figure 9:
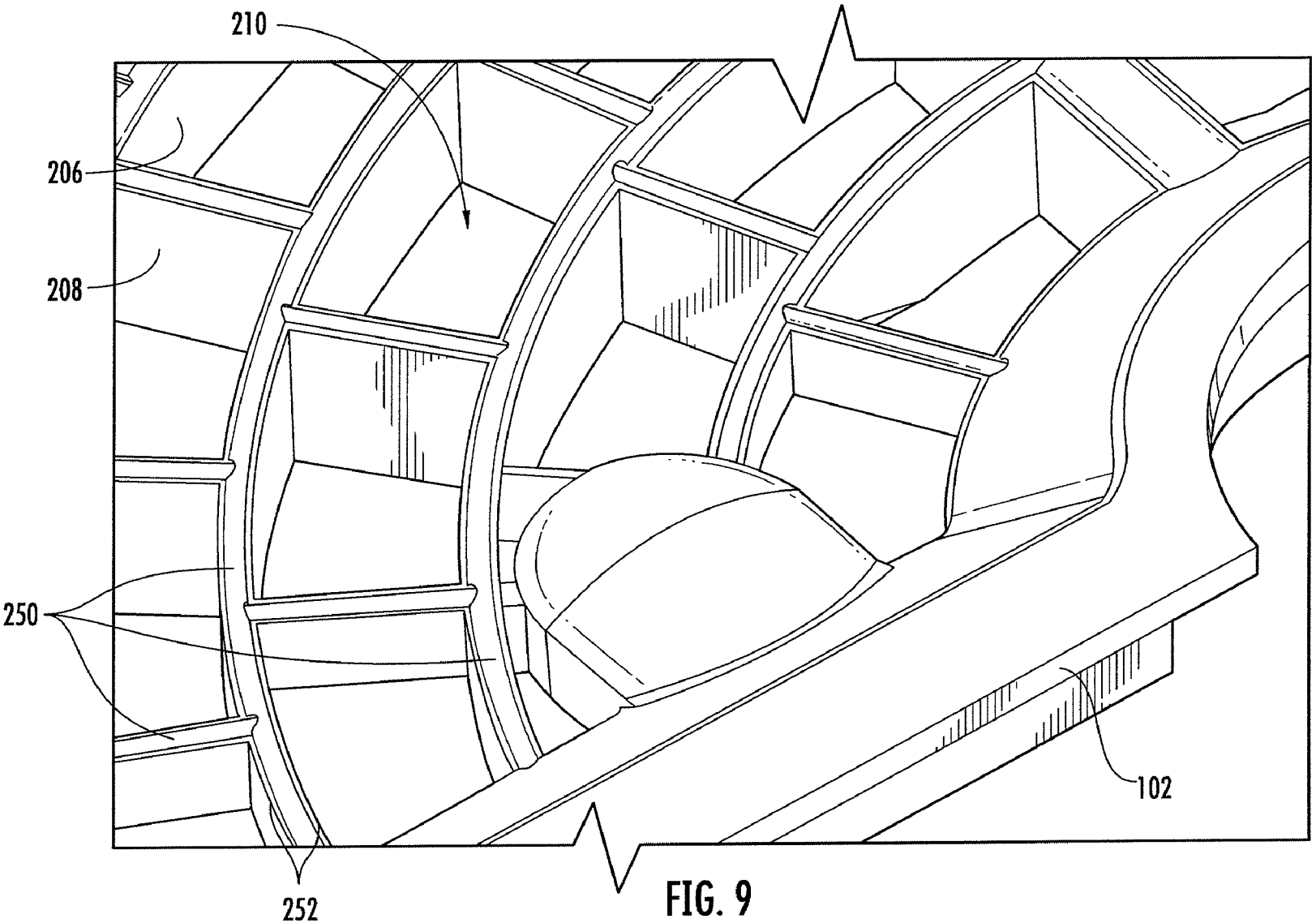
Figure 10A:
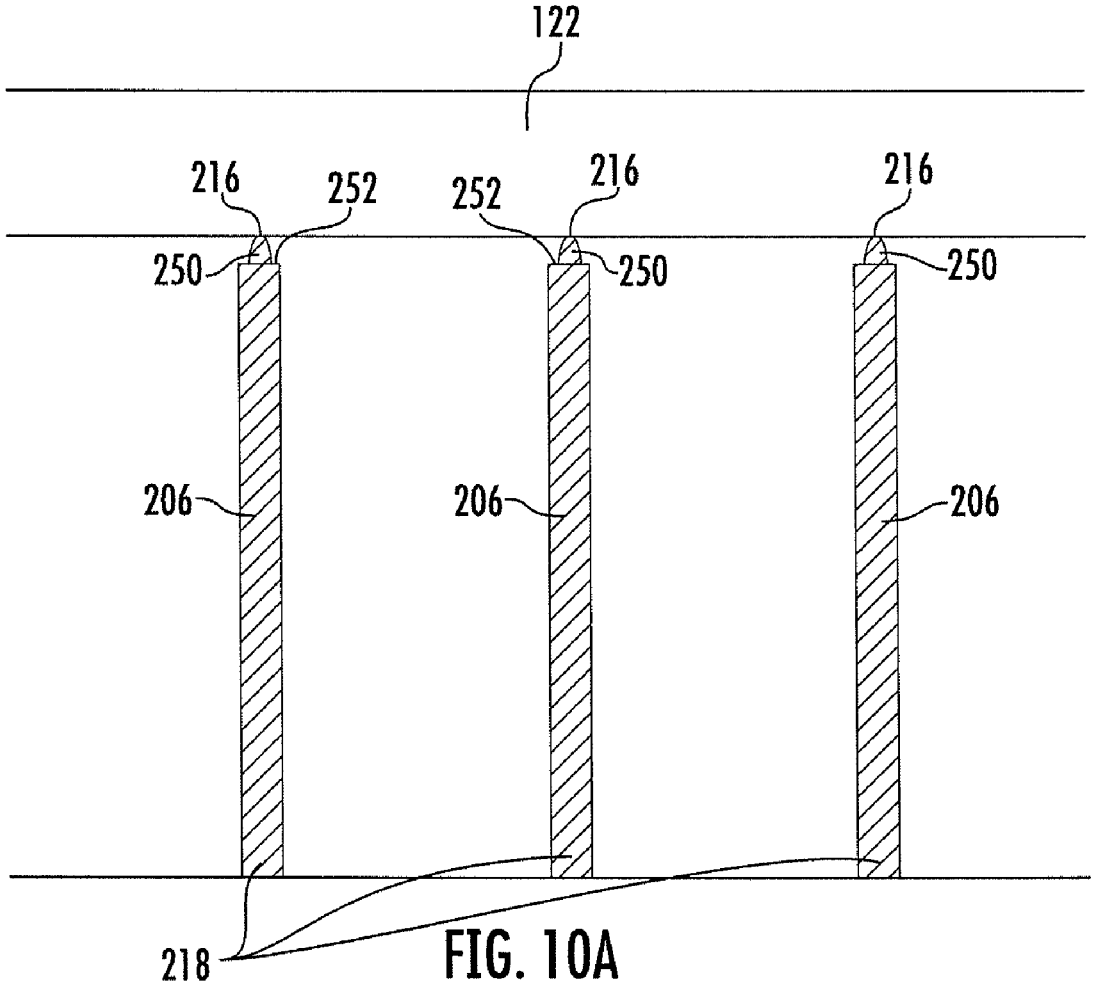
Figure 10B:
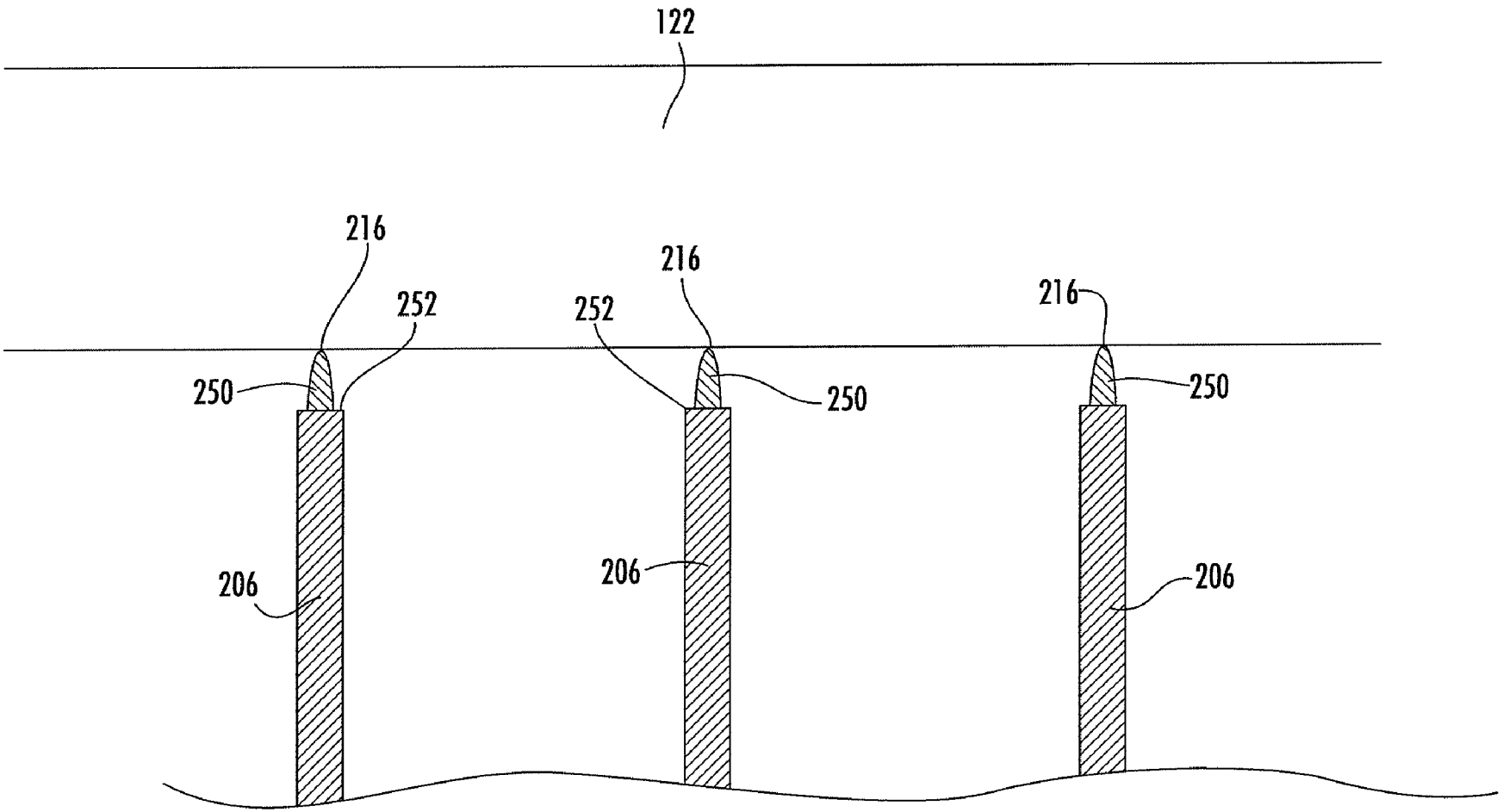
Figure 11A:
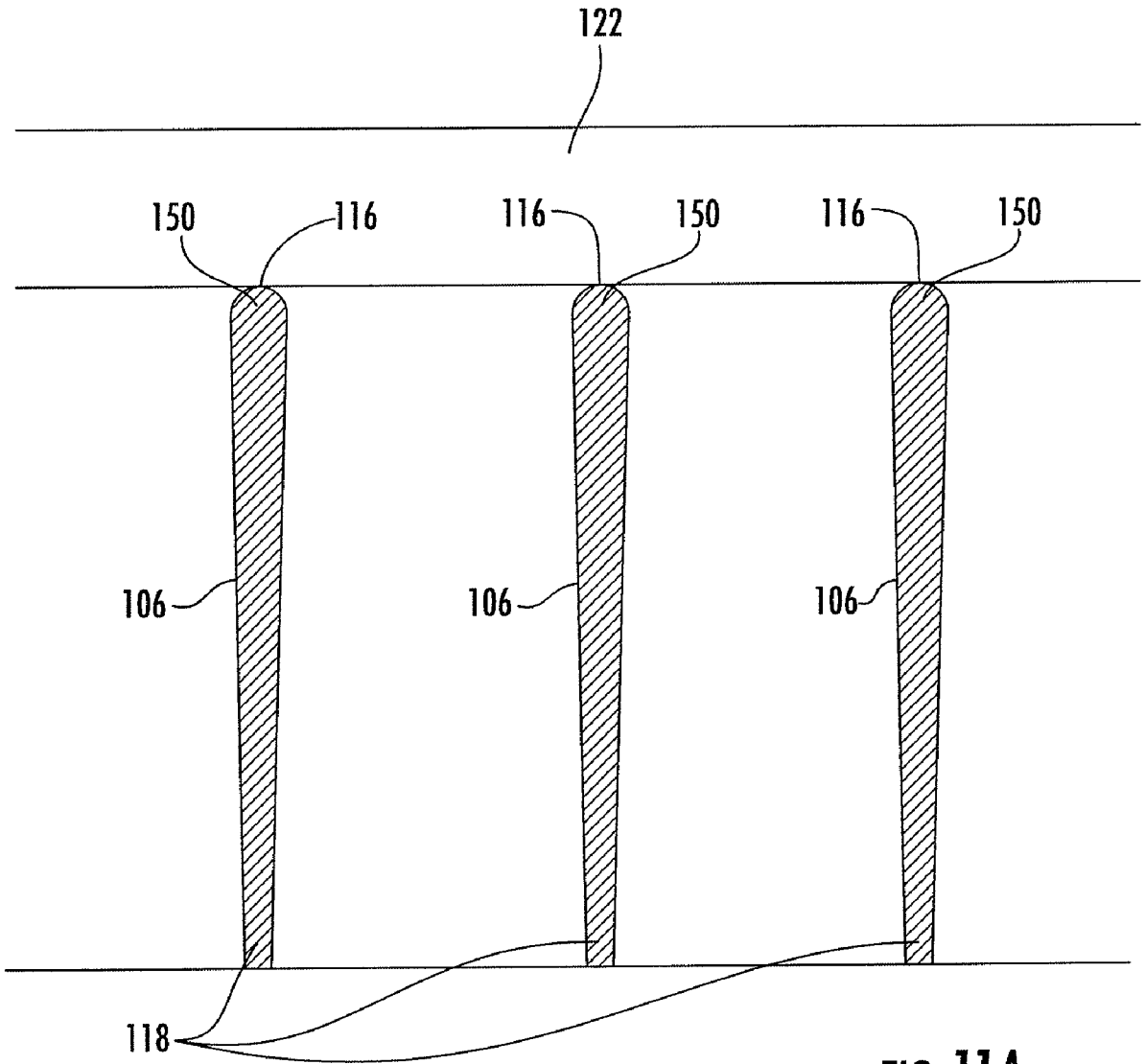
Figure 11B:
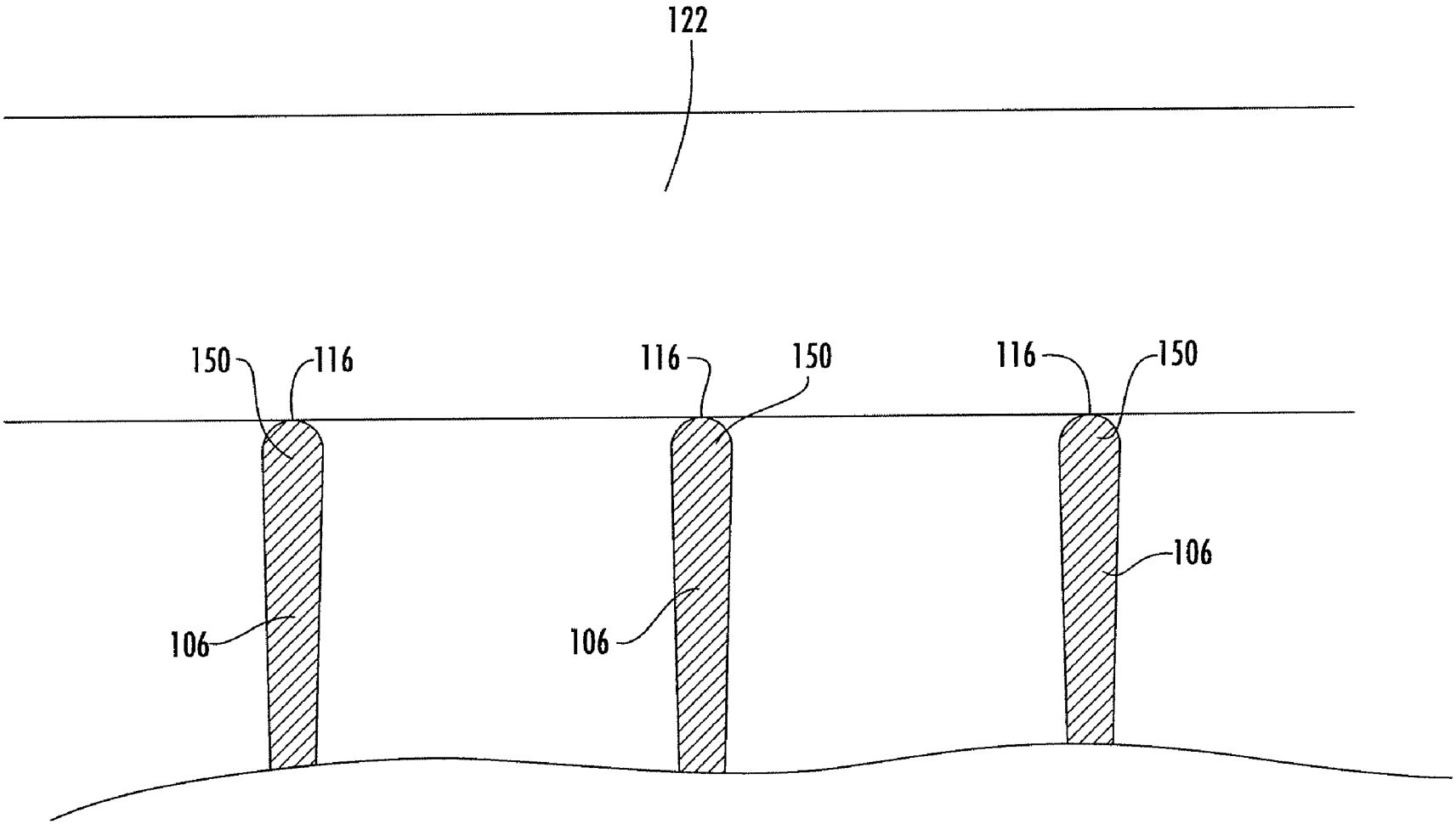
Figure 12:
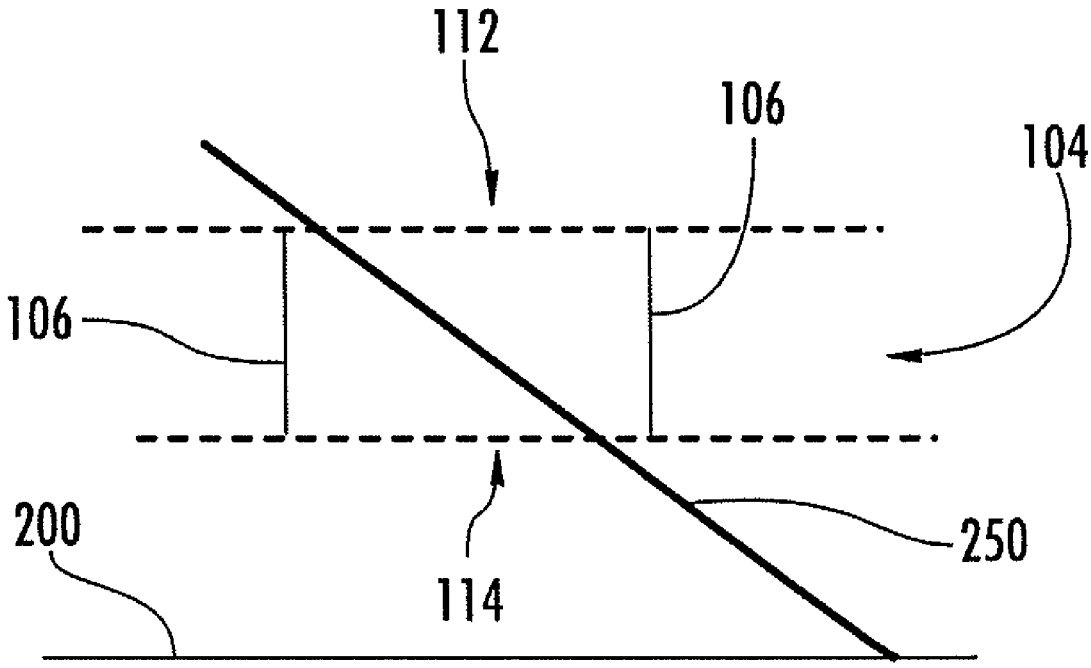

Having thus described various embodiments of the invention in general terms, reference will now be made to the accompanying drawings, which are not necessarily drawn to scale, and wherein:

FIG. 1 is a perspective view of a dishwasher capable of implementing various embodiments of the present disclosure;

FIG. 2 is a fragmentary perspective view of a screening element implemented in a dishwasher apparatus;

FIG. 3 is a schematic perspective view of a screening arrangement according to one embodiment of the present invention;

FIG. 4 is another schematic perspective view of the screening arrangement of FIG. 3, according to one embodiment of the present invention;

FIG. 5A is an upper view of a screening arrangement according to one embodiment of the present invention;

FIG. 5B is a lower view of the screening arrangement of FIG. 5A, according to one embodiment of the present invention;

FIG. 6A is an upper view of a screening arrangement according to one embodiment of the present invention;

FIG. 6B is a cross-sectional view of the screening arrangement along the line A-A of FIG. 6A;

FIG. 7A is a fragmentary cross-sectional view of a screening arrangement having a plurality of intersecting wall members with flared portions toward the lower ends thereof, according to one embodiment of the present invention;

FIG. 7B is a magnified view of the upper ends of the wall members illustrated in FIG. 7A;

FIG. 8 is a schematic perspective view of a screening arrangement according to an alternate embodiment of the present invention;

FIG. 9 is a fragmentary perspective view of the screening arrangement according to the embodiment of FIG. 8;

FIG. 10A is a fragmentary cross-sectional view of a screening arrangement having a plurality of intersecting wall members with inlet ends having cross-sectional arcuate apex portions, according to one embodiment of the present invention;

FIG. 10B is a magnified view of the inlet ends of the wall members illustrated in FIG. 10A;

FIG. 11A is a fragmentary cross-sectional view of a screening arrangement having a plurality of intersecting wall members with inlet ends having cross-sectional arcuate apex portions, wherein the wall members taper from an inlet end thereof toward an outlet end thereof;

FIG. 11B is a magnified view of the inlet ends of the wall members illustrated in FIG. 11A; and FIG. 12 is a schematic view of a screening arrangement cooperating with an interfering member to prevent elongated food soils from passing through the screening arrangement.

DETAILED DESCRIPTION OF VARIOUS EMBODIMENTS OF THE INVENTION

Various embodiments of present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates one example of a dishwashing appliance, such as a dishwasher 10, capable of implementing various embodiments of the present invention. Such a dishwasher 10 typically includes a tub portion 12 (partly broken away in FIG. 1 to show internal details, and also referred to herein as "tub" or "tub 12") having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable lower and upper racks (not shown) for holding the dishes, utensils, and dishware to be washed. A door assembly 100 may be pivotably engaged with the tub portion 12 about the lower end 18 thereof so as to selectively permit access to the interior of the tub portion 12. That is, a lower edge 26 of the door assembly 100 may be pivotably engaged (i.e., hinged) with the lower end 18 of the tub portion 12 such that the door assembly 100 is pivotable about the lower edge 26 thereof to provide access to the interior of the tub portion 12 through the forward access opening 16, and to cover and seal the forward access opening 16 when the dishwasher 10 is in operation.

The tub portion 12 may further define, or have engaged therewith, a sump (or sump assembly), generally designated as element 14, in which wash water or rinse water is collected, typically under the influence of gravity. The sump 14 may cooperate with a bottom wall 17 of the tub portion 12 to form the lower end 18 of the tub portion 12, wherein the bottom wall 17 may be sloped to direct washing fluid toward the sump 14. The wash/rinse water may be pumped/recirculated by a circulation pump 15 out of the sump 14 to various spray arms 20 or other water distribution provisions mounted in the interior of the tub portion 12 for spraying the wash/rinse water, under pressure, onto the dishes, utensils, and other dishware contained therein. The circulation pump 15 and/or other operational components (e.g., drain pump, water valve) may be housed, disposed, or otherwise positioned within a base portion/component 22 beneath the tub portion 12, wherein the base portion 22 receives and supports the lower end 18 of the tub portion 12. In some instances, the base portion 22 may be a separate component with respect to the tub portion 12, such as, for example, a molded polymer component, while in other instances, the base portion 22 may be integral with the tub portion 12 such that the side walls forming the tub portion 12 also at least partially form the base portion 22. Further, a drain system may be connected to the sump 14 for removing the dishwashing fluid from the dishwasher 10. The drain system may include, for example, a drain pump (not shown), hoses, valves, etc. for effectively removing dishwashing fluid and any food soils/particles carried therein away from the dishwasher toward the house drain.

As illustrated in FIG. 2, the dishwashing fluid collected in the sump 14 is re-circulated through the spray arm(s) 20 during the wash and rinse cycles typically implemented by the dishwasher 10. However, since it is generally undesirable to re-circulate the food soils and debris back through the hydraulic system of the dishwasher 10, the dishwasher 10 may include a screening/filtration arrangement associated with the circulation system. For example, the dishwasher 10 may include a coarse filtration or strainer/screening device 28 for straining or screening the dishwashing fluid, which typically removes and retains relatively large particles (i.e., those objects/particles not capable of passing through the drain system of the dishwasher 10) comprising food soils and other debris dislodged from the dishware, as shown in FIG. 2. In some instances, the coarse filtration device 28 separates the tub portion 12 from the sump 14 and/or a drain chamber such that the relatively large particles strained/screened from the dishwashing fluid are retained outside the sump 14/drain chamber.

However, as mentioned previously, prior art filtration arrangements may sometimes include shelf-like members, or portions thereof, having significant horizontal, or substantially horizontal, surface components, forming all or part of the straining/screening portion of the coarse filtration device. As such, these prior art coarse filtration devices may tend to retain relatively small objects (i.e., those objects/particles capable of moving through the coarse filtration device and the drain system), both dissolvable (e.g., corn) and indissolvable (e.g., coffee grounds), as the dishwashing fluid is strained/screened. However, since the coarse filtration device is often the first straining/screening/filtration element acting upon the washing fluid, the coarse filtration device may be directly exposed to the dishwashing fluid output from the spray arms 20 and directed toward the lower end 18. Accordingly, the moving (falling, sprayed, etc.) washing fluid may interact with any small objects retained by the horizontal surfaces of the coarse filtration device, and cause further dissolution of those objects and/or redistribution thereof onto the dishware. That is, since splashing or other displacement of the dishwashing fluid may be apparent in a dishwasher fluid circulation process, particles of the small indissolvable objects and/or further dissolved objects may be carried back to and re-deposited on the dishware, particularly dishware in the lower rack, thereby resulting in a lower cleaning efficiency or cleaning score of the dishwasher. Such smaller objects may include, for example, coffee grounds and corn (in a creamed or partially ground form), which may be readily retained by horizontal, or substantially horizontal surfaces, of prior art coarse filtration devices. In this regard, embodiments of the present invention may be implemented to reduce the likelihood of such smaller particles being retained in proximity to the dishware so as to, in turn, reduce the risk of re-deposition of such particles or portions thereof onto the dishware, while still providing an effective straining/screening/filtering mechanism for removing large objects or particles from the dishwashing fluid.

In accordance with embodiments of the present disclosure, with reference to FIGS. 3-6, the dishwasher 10 may thus include a screening arrangement 100 for filtering/screening/straining washing fluid flowing from the tub portion 12 toward the sump 14. The screening arrangement 100 may be disposed about the lower end 18 of the tub portion 12, essentially separating or partially separating the tub portion 12 and the sump 14 (as similarly shown in FIG. 2). For example, the screening arrangement 100 may be configured to comprise one of the one or more channels of fluid communication between the tub portion 12 and the sump 14. In some instances, the screening arrangement 100 may provide the only fluid communication channel extending from the tub portion 12 to the sump 14. In any instance, the bottom wall 17 may define an aperture configured to receive the screening arrangement 100, typically in a manually removable/replaceable manner. In one embodiment, the screening arrangement 100 may include a lip portion 102 extending at least partially about the peripherally thereof, with the lip portion 102 being configured to support the screening arrangement 100 with respect to a receiving aperture defined by a portion of the bottom wall 17 or other component cooperating therewith to form the bottom wall 17. In this manner, the screening arrangement 100, installed in the dishwasher 10, may be positioned so as not to interfere with other components of the dishwasher 10 disposed about the lower end 18 of the tub portion 12. Accordingly, the screening arrangement 100 may be positioned and configured to provide effective screening/straining of washing fluid entering the sump 14 from the tub portion 12. The screening arrangement 100 may be comprised of a polymeric material or any other suitable material and, in some instances, may be integrally formed (i.e., by molding, by casting, or by any other suitable forming process) to include the components and configurations disclosed herein.

The screening arrangement 100 may comprise a plurality of intersecting wall members forming a latticework structure, generally designated as 104, at least partially surrounded by a circumferential member 120, as further discussed herein. The wall members may, in some instances, be configured to extend vertically so as to be substantially perpendicular to the bottom wall 17. For example, the latticework structure 104 may include a plurality of concentric arcuate wall members 106 spaced-apart from each other and extending angularly about a vertical axis of a shaft 30 (FIG. 2) to which a lower spray arm 20 may be mounted. The latticework structure 104 may further include a plurality of planar wall members 108 substantially perpendicularly intersecting the arcuate wall members 106. That is, in such instances, the planar wall members 108 may be angularly spaced-apart from each other and oriented to extend radially outward from the vertical axis of the shaft 30. Accordingly, the arcuate wall members 106 and the planar wall members 108 may intersect to define channels 110 through which the dishwashing fluid flows from the tub portion 12 toward the sump assembly 14 (or other filtration components). One of ordinary skill in the art will appreciate, however, that the wall members may be arranged in any suitable configuration such as, for example, having substantially parallel extending wall members intersecting perpendicularly with other substantially parallel extending wall members to form a rectangular grid-like structure (or alternative "latticework structure" as otherwise disclosed herein).

Each of the wall members 106, 108 includes an inlet end 116 disposed toward the tub portion 12 (FIG. 5A), and an opposed outlet end 118 disposed toward the sump assembly 14 (FIG. 5B). In some instances, the inlet ends 116 cooperate to define an inlet plane, generally designated as 112, and the outlet ends 118 cooperate to define an outlet plane, generally designated as 114. The inlet ends 116, in cross section, include a non-planar apex portion 150 tapering toward the outlet plane 114. For example, the apex portion 150 may have a substantially arcuate form 150A (i.e., "dome" shaped) or, in other instances, have a substantially angular form (i.e., diverge) from a point 150B to form a knife-edge profile. Such configurations of the inlet ends 116 may provide a non-planar portion about the fluid entrance of the screening arrangement 100 for promoting breakdown of food soils, while also reducing the horizontal surface component about the fluid entrance of the screening arrangement 100. In some embodiments, the latticework structure 104 may comprise a variety of non-planar apex portions 150, such as, for example, a combination of arcuate 150A and angular 150B apex portions. The inlet ends 116 further collectively define an inlet surface area, while the outlet ends 118 further collectively define an outlet surface area, wherein the term "surface area" generally indicates the area of the ends 116, 118 exposed to the respective inlet and outlet planes 112, 114). Generally, the washing fluid directed toward the lower end 18 of the tub portion 12, under the influence of gravity, traverses the inlet plane 112 and then the outlet plane 114, through the latticework structure 104, before being further directed toward the sump 14 or other filtration component(s).

In accordance with some aspects of the present invention, the screening arrangement 100 may be particularly configured so as to avoid retention of relatively small particles (e.g., food soils capable of passing through the screening arrangement 100 and the drain system) having a tendency to be retained on horizontal upper surfaces of prior art screening arrangements, while still maintaining the ability to retain, or promote the retention of, relatively large particles. In this regard, in one instance, the latticework structure 104 may be configured such that the arcuate wall members 106 and/or the planar wall members 108 diverge upon extension from the inlet plane 112 toward the outlet plane 114. That is, as shown more clearly in FIG. 6B, the configuration of the inlet ends 116 is reduced or otherwise minimized in cross-section with respect to the outlet ends 118 such that the inlet surface area is less than the outlet surface area, as shown in FIGS. 5A and 5B. As such, the wall members 106, 108 may be configured to taper, in a linear or non-linear manner, from the outlet ends 118 to the inlet ends 116. In this manner, providing larger openings for the channels 110 about the inlet plane 112 may facilitate food soils, both dissolvable and indissolvable, entering through the inlet plane 112, while the smaller openings at the outlet plane 114 may prevent or otherwise hinder large particles/soils from entering the sump 14/drain chamber. Accordingly, the latticework structure 104 may be configured such that passage therethrough is facilitated to particles/objects that are capable of moving through the drain system (i.e., hoses, valves, etc.) of the dishwasher 10. In other instances, however, the configuration of the outlet ends 118 may be reduced or otherwise minimized in cross-section with respect to the inlet ends 116 such that the outlet surface area is less than the inlet surface area, as shown in FIGS. 11A and 11B. That is, the latticework structure 104 may be configured such that the arcuate wall members 106 and/or the planar wall members 108, taper or otherwise converge, in a linear or non-linear manner, upon extension from the inlet plane 112 toward the outlet plane 114.

As mentioned previously, the inlet ends 116 may be configured to have a cross-sectional non-planar apex portion 150 with, for example, an angular form ("knife-like" or otherwise "sharp" edge), or a rounded or otherwise arcuate form, each of which may be particularly configured to facilitate breakdown or dissolution of dissolvable particles/objects and/or to facilitate such particles/objects being directed through the latticework structure 104 toward the sump 14, instead of being retained by surfaces associated with the inlet plane 112. Further, such a configuration facilitates smaller particles/objects, both dissolvable and indissolvable, being received and directed through the latticework structure 104 toward the sump 14, rather than being retained by surfaces associated with the inlet plane 112. More particularly, in instances where the wall members 106, 108 converge in cross-section from the inlet end 116 toward the outlet end 118, the opening dimensions of the channels 110 about the inlet end 116 may be configured in accordance with the maximum size particle/object capable of passing through the drain system. As such, the non-planar apex portion 150 of the wall members 106, 108 first facilitates that any such particles/objects are directed into the channels 110 without being retained by any significant horizontally-extending surfaces. Once the particles/objects are directed into the channels 110, the convergent wall member 106, 108 (converging from the inlet ends 116 toward the outlet ends 118) minimizes any frictional engagement with the particles/objects so as to facilitate passage thereof through the latticework structure 104.

However, configuring the latticework structure 104 to promote the passage of relatively small particles may sometimes undesirably allow the passage of relatively large particles (i.e., toothpicks, bones) therethrough. As such, the screening arrangement 100 and/or the latticework structure 104 may be further configured to prevent or otherwise reduce the risk of such relatively large particles from passing therethrough. For example, the arcuate wall members 106 and/or the planar wall members 108 may be configured to diverge from the inlet plane 112 toward the outlet plane 114, such that dimensions of the openings defined by the latticework structure 104 about the outlet plane 114 are sufficiently reduced in size to prevent such relatively large particles from passing through the latticework structure 104. In some instances, as shown in FIGS. 7A and 7B, at least some of the wall members 106, 108 may be configured such that the slope thereof decreases toward the outlet ends 118 thereof, such that the corresponding wall members 106, 108 essentially "flare" toward the outlet ends 118 (in addition to any linear divergence from the inlet end 116 toward the outlet end 118), wherein the flared portion 119 further promotes the relative difference of the outlet surface area over the inlet surface area. In addition, the flared portions 119 may assist in retaining elongate objects/particles, such as toothpicks and bones, and prevent the same from passing through the latticework structure 104. That is, an elongate particle entering the latticework structure 104 at an acute angle would be impeded by the flared portions 119 (i.e., horizontally-extending portions of adjacent wall members 106, 108) to prevent the elongate particle from passing through the latticework structure 104. Such a configuration may be advantageous, for example, in preventing such elongated objects from passing through the screening arrangement 100. Also, in instances of objects being retained by the diverging wall members 106, 108, or flared portions 119, such retention may occur further toward the outlet plane 114, away from the inlet plane 112, wherein the object is likely bounded by the wall members 106, 108. As such, any further dissolution of such an object through interaction with moving washing fluid from the tub portion 12 or any dislodgement of objects from the wall members 106, 108 may be limited with respect to the risk of re-deposition on the dishware through the confining effect of the wall members 106, 108.

In some instances, the screening arrangement 100 may further include a circumferential member 120 extending at least partially about the periphery of the latticework structure 104, wherein the circumferential member 120 may provide, at least in part, the lip member 102 for supporting the screening arrangement 100 with respect to the bottom wall 17 of the tub portion 12. The circumferential member 120 may be operably engaged with the latticework structure 104 in any suitable manner. For example, the circumferential member 120 may be integrally-formed with the latticework structure 104, for example, by a molding, casting, or machining process, or other suitable process. Further, the circumferential member 120 and the latticework structure 104 may be comprised of the same material or different materials, or combinations of materials. In one instance, for example, the circumferential member 120 and the latticework structure 104 may be integrally formed of a single polymeric material. In other instances, the circumferential member 120 may be secured, attached, or otherwise connected to the latticework structure 104 by fasteners, adhesives, or other suitable connection mechanisms. In some instances, at least a portion of the circumferential member 120 may be sloped inwardly toward the latticework structure 104 so as to direct or promote the direction of any washing fluid and/or particles interacting therewith toward the latticework structure 104, while discouraging retention of the same thereon. For example, a portion 122 of the circumferential member 120 may be sloped inwardly toward the latticework structure 104, in a direction extending from the inlet plane 112 toward the outlet plane 114. In this manner, the circumferential member 120 assists in providing a horizontal velocity component to the dishwashing fluid so as to prevent or reduce the risk of food soils being retained on surfaces having a horizontal component, such as the circumferential member 120 itself, the wall members 106, 108, and/or any surface disposed beneath and adjacent to the screening arrangement 100. In this manner, foods soils carried by the dishwashing fluid are more readily swept into and through the latticework member 104.

In an alternate embodiment, as shown in FIGS. 8, 9, 10A and 10B, the latticework structure 104 may be configured as previously discussed, including a plurality of first planar wall members 206 and a plurality of second planar wall members 208 substantially perpendicularly intersecting the first planar wall members 206. Each of the wall members 206, 208 includes an inlet end 216 disposed toward the tub portion 12, and an opposed outlet end 218 disposed toward the sump assembly 14. In some instances, the inlet ends 216 cooperate to define an inlet plane, generally designated as 212, and the outlet ends 218 cooperate to define an outlet plane, generally designated as 214. The inlet ends 216, in cross section, include a non-planar apex portion 250 tapering toward the outlet plane 214. For example, the cross-section of the apex portion 250 may have a substantially arcuate form (dome-shaped) or, in other instances, a substantially angular form (divergent from a point such as a knife-edge profile), or any combination thereof, so as to provide a non-planar portion about the inlet plane 212 for facilitating breakdown and/or non-retention of food soils, while reducing the horizontal surface area component of the screening arrangement 100 about the inlet plane 212. In some instances, the non-planar apex portion 250 may taper to opposing and substantially planar portions 252, though such planar portions 252 may be included to facilitate manufacturability, and not necessarily for addressing aspects of the present invention as disclosed herein.

As further shown in FIG. 12, the sloped surface of the circumferential member 120 may provide the dishwashing fluid directed toward the latticework structure 104 with a horizontal velocity component for facilitating removal of soils from an interfering member 200 (e.g., a surface defining the sump or other component disposed adjacent to the outlet plane 214) disposed below the outlet plane 214 (similarly applicable to the embodiment shown in FIGS. 3-6, 7A and 7B) and directing such soils toward the drain chamber. That is, in some instances, an interfering member 200 (i.e., a surface defining the sump or other component disposed adjacent to the outlet plane 114, 214) may be operably engaged with the screening arrangement 100. For example, the interfering member 200 may be a substantially planar component disposed substantially parallel to and spaced apart from the outlet plane 114, 214 and extending at least partially across the latticework structure 104. The interfering member 200 may be sufficiently spaced apart from the latticework structure 104 to allow the soils and washing fluid passing through the latticework structure 104 to flow therebetween toward the sump assembly 14 in a nonlinear flow path, but otherwise configured to cooperate with the latticework structure 104 to impede the passage of thin elongate objects 250 (i.e., toothpicks, bones, etc.) through the screening arrangement 100. The elongate objects may then be manually removed at the end of the dishwasher program/cycle. The interfering member 200 may be, for example, an integral portion of, fastened to, or otherwise engaged (permanently or removably) with the screening arrangement 100 and/or the sump assembly 14. For example, the interfering member 200 may be a surface defining the sump 14. In other instances, the interfering member 200 may be a discrete component configured to interact with the screening arrangement 100. The interfering member 200 may be configured as, for example, a substantially planar member, but may also be configured to include a sloped or arcuate surface directed toward the outlet plane 114, 214, or may be otherwise configured to facilitate drainage of the washing fluid therefrom.

In some embodiments, a handle member 130 may be provided for facilitating removal and replacement of the screening arrangement 100 with respect to the bottom wall 17 for cleaning of the screening arrangement 100 or other maintenance. As shown in FIGS. 3-6 and 8, the handle member 130 may be operably engaged with the circumferential member 120 and/or the latticework structure 104. For example, the handle member 130 may be integrally-formed with the circumferential member 120 or attached, secured, or otherwise connected thereto with appropriate fasteners or adhesives. In some instances, the handle member 130 may extend in an offset manner away from the circumferential member 120 so as to facilitate removal and replacement of the screening arrangement 100.

As such, embodiments of the present invention may substantially eliminate soil-retaining horizontally-extending surfaces toward the inlet plane such that the relatively small particles, both dissolvable and indissolvable, may be carried by the washing fluid out of a proximity to the dishware and/or into a constrained environment such that the risk of any re-deposition thereof onto the dishware, through interaction with the washing fluid, is reduced (i.e., such particles are prevented from being, or otherwise made unlikely to be, re-deposited on the dishware once directed to screening arrangement 100). In this manner, cleaner dishware (i.e., a higher cleaning score) may be obtained in a more efficient manner (i.e., fewer drains/fills, improved wash performance, and/or reduced energy consumption).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A screening arrangement for a dishwashing appliance having a tub portion adapted to contain washing fluid circulated about dishware received therein, the dishwashing appliance having a sump assembly disposed about a lower end of the tub portion for receiving the washing fluid therein, the screening arrangement comprising:

a plurality of intersecting wall members forming a latticework structure defining an inlet plane and an opposed outlet plane, each of the wall members having an inlet end disposed toward the inlet plane and an outlet end disposed toward the outlet plane, the inlet ends of the wall members, in cross section, having a non-planar apex portion angling toward the outlet plane, wherein washing fluid from the tub portion is received through the inlet plane and directed toward the outlet plane; and a circumferential member operably engaged with and extending about a periphery of the latticework structure, at least a portion of the circumferential member being sloped toward the latticework structure, from the inlet plane toward the outlet plane, so as to direct washing fluid received thereby through the latticework structure and toward the sump assembly.

2. A screening arrangement according to claim 1 wherein the wall members are each configured to diverge with a substantially constant slope from the inlet end toward the outlet end.

3. A screening arrangement according to claim 1 wherein the wall members are each configured to converge from the inlet end toward the outlet end.

4. A screening arrangement according to claim 1 wherein the wall members are each configured to diverge with a decreasing slope so as to have a flared portion toward the outlet end.

5. A screening arrangement according to claim 1 wherein the apex portion of the inlet end of each wall member is configured to have at least one of an angular form and an arcuate form.

6. A screening arrangement according to claim 1 wherein the latticework structure and the circumferential member are integrally-formed.

7. A screening arrangement according to claim 1 further comprising a handle member operably engaged with one of the latticework structure and the circumferential member.

8. A screening arrangement according to claim 1 further comprising an interfering member disposed adjacent to the latticework structure in substantially parallel relation to the outlet plane, the interfering member being configured to cooperate with the latticework structure to form a non-linear flow path for the washing fluid from the latticework structure toward the sump assembly.

9. A screening arrangement according to claim 1, wherein the wall members comprise a plurality of arcuate members spaced apart concentrically from one another and a plurality of planar wall members extending therebetween.

10. A dishwashing appliance comprising:

a tub portion adapted to contain washing fluid circulated about dishware received therein;

a sump assembly disposed about a lower end of the tub portion for receiving the washing fluid therein; and a screening arrangement disposed between the lower end of the tub portion and the sump assembly for screening the washing fluid directed therethrough, the screening arrangement comprising:

a plurality of intersecting wall members forming a latticework structure defining an inlet plane and an opposed outlet plane, each of the wall members having an inlet end disposed toward the inlet plane and an outlet end disposed toward the outlet plane, the inlet ends of the wall members, in cross section, having a non-planar apex portion angling toward the outlet plane, wherein washing fluid from the tub portion is received through the inlet plane and directed toward the outlet plane; and a circumferential member operably engaged with and extending about a periphery of the latticework structure, at least a portion of the circumferential member being sloped toward the latticework structure, from the inlet plane toward the outlet plane, so as to direct washing fluid received thereby through the latticework structure and toward the sump assembly.

11. A dishwashing appliance according to claim 10 wherein the wall members are each configured to diverge with a substantially constant slope from the inlet end toward the outlet end.

12. A dishwashing appliance according to claim 10 wherein the wall members are each configured to converge from the inlet end toward the outlet end.

13. A dishwashing appliance according to claim 10 wherein the wall members are each configured to diverge with a decreasing slope so as to have a flared portion toward the outlet end.

14. A dishwashing appliance according to claim 10 wherein the apex portion of the inlet end of each wall member is configured to have at least one of an angular form and an arcuate form.

15. A dishwashing appliance according to claim 10 wherein the latticework structure and the circumferential member are integrally-formed.

16. A dishwashing appliance according to claim 10 wherein the screening arrangement further comprises a handle member operably engaged with one of the latticework structure and the circumferential member.

17. A dishwashing appliance according to claim 10 further comprising an interfering member disposed adjacent to the latticework structure in substantially parallel relation to the outlet plane, the interfering member being configured to cooperate with the latticework structure to form a non-linear flow path for the washing fluid from the latticework structure toward the sump assembly.

18. A dishwashing appliance according to claim 10, wherein the wall members comprise a plurality of arcuate members spaced apart concentrically from one another and a plurality of planar wall members extending therebetween.

* * * * *